US008189023B2

(12) United States Patent
Howell et al.

(10) Patent No.: US 8,189,023 B2
(45) Date of Patent: May 29, 2012

(54) THERMAL TRANSFER PRINTING

(75) Inventors: Jeffrey Michael Howell, Ipswich (GB); Peter Charles William Butcher, Tollesbury (GB)

(73) Assignee: Akzo Nobel Coatings International B.V., Arnhem (NL)

( * ) Notice: Subject to any disclaimer, the term of this patent is extended or adjusted under 35 U.S.C. 154(b) by 342 days.

(21) Appl. No.: 12/665,785

(22) PCT Filed: Jun. 17, 2008

(86) PCT No.: PCT/GB2008/002068

§ 371 (c)(1), (2), (4) Date: Dec. 21, 2009

(87) PCT Pub. No.: WO2009/001034

PCT Pub. Date: Dec. 31, 2008

(65) Prior Publication Data

US 2010/0188471 A1 Jul. 29, 2010

(30) Foreign Application Priority Data

Jun. 22, 2007 (GB) ..... 0712105.6

(51) Int. Cl.
*B41J 17/30* (2006.01)

(52) U.S. Cl. ..... 347/217

(58) Field of Classification Search ..... 347/217, 347/218, 221, 215, 212, 61, 65
See application file for complete search history.

(56) References Cited

U.S. PATENT DOCUMENTS

| | | | | |
|---|---|---|---|---|
| 6,923,529 | B2 * | 8/2005 | Chwalek et al. | 347/74 |
| 7,102,660 | B2 | 9/2006 | Clifton et al. | |
| 7,780,271 | B2 * | 8/2010 | North et al. | 347/65 |

FOREIGN PATENT DOCUMENTS

| | | |
|---|---|---|
| WO | WO 98/02315 | 1/1998 |
| WO | WO 01/96123 | 12/2001 |
| WO | WO 02/096661 | 12/2002 |
| WO | WO 2004/022354 | 3/2004 |
| WO | WO 2007/049070 | 5/2007 |

OTHER PUBLICATIONS

International Search Report and Written Opinion, PCT International Application PCT/GB2008/002068, Oct. 10, 2008.
International Preliminary Report on Patentability, PCT International Application PCT/GB2008/002068, Dec. 22, 2009.

* cited by examiner

*Primary Examiner* — Kristal Feggins
(74) *Attorney, Agent, or Firm* — Kenyon & Kenyon LLP

(57) ABSTRACT

Apparatus for thermal transfer printing of an image from a thermal retransfer sheet onto an article, includes heating means adapted to supply a flow of heated gas for causing dye transfer, and oscillating vane means for directing the heated gas in a direction transverse to the direction of flow, for distributing the heated gas over article(s) during dye transfer. Also disclosed is a method of printing an image, and the resulting printed article.

14 Claims, 5 Drawing Sheets

THERMAL TRANSFER PRINTING

FIELD OF THE INVENTION

This invention relates to thermal transfer printing, and concerns apparatus for thermal transfer printing of an image from a retransfer intermediate sheet onto an article, a method of printing and an article bearing a printed image.

BACKGROUND TO THE INVENTION

Thermal retransfer printing involves forming an image (in reverse) on a retransfer intermediate sheet using one or more thermally transferable dyes. The image is then thermally transferred to a surface of an article by bringing the image into contact with the article surface and applying heat and possibly also pressure. Thermal transfer printing is particularly useful for printing onto articles that are not readily susceptible of being printed on directly, particularly three dimensional (3D) objects. Thermal retransfer printing by dye diffusion thermal transfer printing, using sublimation dyes, is disclosed, e.g., in WO 98/02315 and WO 02/096661. By using digital printing techniques to form the image on the retransfer intermediate sheet, high quality images, possibly of photographic quality, can be printed on 3D articles relatively conveniently and economically even in short runs. Indeed such objects can be personalised economically.

Using suitable retransfer intermediate sheets, it is possible to form good quality images on 3D articles, possibly having complex shapes including curved shapes (concave or convex) including compound curves. When printing onto 3D articles, the sheet is typically preheated, e.g. to a temperature in the range 80 to 170° C., prior to application to the article, to soften the sheet and render it deformable. The softened sheet is then in a condition in which it can be easily applied to and conform to the contours of an article. This is conveniently effected by application of a vacuum to cause the softened sheet to mould to the article. While the sheet is maintained in contact with the article, e.g. by maintenance of the vacuum, the sheet, and also the article, are heated to a suitable temperature for dye transfer, typically a temperature in the range 140 to 200° C., for a suitable time, typically in the range 15 to 150 seconds. After dye transfer, the article is allowed or caused to cool before removal of the retransfer intermediate sheet. Suitable apparatus for performing the retransfer printing step is disclosed e.g. in WO 01/96123 and WO 2004/022354.

Heating of the sheet and article is conveniently effected by exposure to a stream of hot air generated from heating means comprising a fan and electrical heater elements. In known apparatus, the air enters a hood and is directed over articles located in a cavity of the apparatus. In some current systems, air is passed through a diffuser comprising an arrangement of static guides. By careful arrangement of the guides, air distribution over the articles and associated sheet can be achieved that is uniform and optimised, provided the articles have a relatively flat profile and provided the articles are located centrally in the cavity. However, the air distribution is not optimised for articles that have upwardly projecting portions, as side or lower surfaces of the articles tend to remain cooler than upper surfaces, nor for articles located close to the edges of the cavity, as surfaces remote from the centre of the cavity tend to be less well heated. This results in uneven heating of the articles and sheet and consequent variable dye transfer, with potentially poor dye transfer occurring on cooler regions of articles. This can result in poor overall print quality.

SUMMARY OF THE INVENTION

In one aspect, the present invention provides apparatus for thermal transfer printing of an image from a thermal retransfer sheet onto an article, wherein the apparatus includes heating means adapted to supply a flow of heated gas for causing dye transfer, and oscillating vane means for directing the heated gas in a direction transverse to the direction of flow, for distributing the heated gas over article(s) during dye transfer.

By having oscillating vane means, the heated gas is distributed laterally and can be distributed more uniformly over articles and an associated sheet, including articles with upwardly projecting portions, articles with inclined, e.g. vertical, side walls, and articles not located centrally in the apparatus. Lateral distribution of the heated gas means that any potential cold spots on the articles and sheet tend to be evened out, resulting in more uniform dye transfer and better print quality. Oscillating vane means also have the benefit of not significantly reducing the volumetric flow of gas, as the cross-sectional area of the vane(s) in the direction of gas flow is small.

Oscillating vane means are found to work well and to have benefits over other approaches to overcoming the problem of uneven heating. For example, attempts to direct gas flow to the sides of the apparatus using a more aggressive diffuser resulted in reduced gas flow and cold spots elsewhere in the apparatus. Other approaches using steerable nozzles are mechanically complex and also restrict air flow.

The oscillating vane means comprises one or more vanes, typically multiple vanes e.g. in a ganged arrangement to move together, mounted for oscillating movement in a direction transverse to the direction of flow of heated gas, with gas passing over the vanes, and typically between adjacent vanes, to be directed to different parts of the apparatus depending on the position of the vane(s) in the oscillation cycle. A vane is suitably an elongate generally planar member.

The vane or vanes are conveniently pivotally mounted, and in a simple arrangement are driven by reciprocating push rod.

The oscillating vane means are desirably driven by an electric motor that may be linked to a reciprocating member, e.g. push rod. The reciprocating member is driven to produce a desired oscillation profile and is conveniently driven by a cam that converts the rotary motion of the motor to an appropriate linear motion.

The oscillating vane means may be designed having regard to the 3D shape of the articles to be printed, to produce an oscillation profile designed to produce uniform, even heating of all parts of the article surfaces to be printed (and associated regions of the sheet), with the aim of producing a temperature profile that is flat and constant across all regions being printed. To this end, the oscillation profile will, for instance, suitably be such that heated gas is directed towards vertical sides of articles and peripherally located articles for longer than it is directed at horizontal surfaces of articles and centrally located articles.

A desired oscillation profile is conveniently achieved by use of an appropriately shaped cam, in known manner. The cam may be removable so that different cams may be used in the apparatus for printing of differently shaped articles.

The speed of oscillation may be regulated as required, e.g. by appropriate regulation of an associated electric motor in known manner, and is generally in the range 5 to 200 strokes per minute, with about 25 strokes per minute being a suitable typical rate.

The apparatus may be customised to suit particular articles by varying one or more factors including the number, size, position and configuration of the vanes, the oscillation profile (e.g. by use of a suitable cam) and possibly also oscillation speed.

The apparatus may include an optional diffuser assembly upstream or downstream of the oscillating vane means, arranged to distribute heated gas in a direction transverse, e.g. at right angles, to the lateral distribution produced by the oscillating vane means.

The apparatus may additionally or alternatively optionally include a second oscillating vane means, downstream of the first oscillating vane means and arranged transversely, e.g. at right angles, thereto to distribute heated gas in a direction transverse to the lateral distribution produced by the first oscillating vane means. The second vane means may be generally similar in construction and operation to the first oscillating vane means.

The apparatus may otherwise be of conventional construction and may be used in conventional manner.

The heating means thus conveniently comprise a heater element and a fan.

The heating means is operable to cause preheating of the sheet (typically to a temperature in the range 80 to 170° C.) to soften the sheet, and also for heating the sheet (typically to a temperature in the range 120 to 240° C., commonly about 160° C.) to cause dye transfer. The heating means may also be used for optional preheating of articles to be treated (typically to a temperature in the range 100 to 120° C.).

Generally, the oscillating vane means will be activated whenever the heating means is activated, during all heating steps.

The heated gas is commonly air.

The apparatus includes means for bringing the sheet and article into intimate contact ready for the dye transfer step. Such means typically comprise vacuum means, with the apparatus thus being a vacuum press. The vacuum means conveniently comprises a vacuum pump and associated bleed valve.

The apparatus typically includes a support for holding one or more articles to be printed, including optional nests or moulds shaped to be complementary to the items to be printed on, to act as a support therefor and prevent distortion of items such as thin-walled plastics articles that might otherwise distort on heating.

The apparatus suitably includes means for holding a thermal retransfer sheet in position, over an article to be printed on.

Means are desirably provided for causing relative movement between the article and sheet, to bring the sheet (in softened condition after preheating) and article into contact, with the support conveniently including elevating means for raising and lowering the support.

The apparatus conveniently includes cooling means, typically in the form of a fan for directing a flow of cold air over the article and sheet after printing for cooling both.

The apparatus suitably includes computer control means for regulating operation of the heating means, vacuum means, cooling means and elevating means and possibly also oscillating vane means, particularly the vane oscillation rate. The control means may include a number of preset programs suitable for printing a variety of different materials, and may also be programmable by a user to suit other requirements.

The apparatus can be used to print images onto articles made of a wide range of materials including plastics, metal, ceramics, wood, composite materials etc. with the articles being of solid or thin-walled construction. Depending on the nature of the surface of the article on which the image is to be printed, it may be appropriate to pre-treat the surface by application of a surface coating or lacquer to improve the take up of transferred dyes.

The apparatus is particularly intended for printing onto 3D articles, possibly having complex shapes including curved shapes (concave or convex) including compound curves.

Suitable thermal retransfer sheets are commercially available, such as Pictaflex media (Pictaflex is a Trade Mark) from ICI Imagedata.

Images may be formed on the retransfer sheet by printing with suitable thermally transferable dyes, preferably by inkjet printing.

In a further aspect, the present invention provides a method of printing an image from a thermal retransfer sheet onto an article, comprising causing the sheet and article to come into contact; and heating the sheet by exposure to a flow of heated gas to cause dye transfer from the sheet to the article, wherein the heated gas is directed in an oscillating manner in a direction transverse to the direction of flow, to distribute the heated gas over the article during dye transfer.

The heated gas is preferably caused to be directed with an oscillation profile designed having regard to the shape of the article, with the aim of producing a uniform temperature over the surface of the article being printed.

The gas is conveniently directed by use of oscillating vane means, preferably under control of an appropriately shaped cam to produce a desired oscillation profile.

The oscillation rate is suitably typically in the range 5 to 200 strokes per minute, and good results have been obtained with a rate of about 25 strokes per minute.

The heated gas may optionally also be diverted in oscillating manner in a second direction transverse, e.g. at right angles, to the first direction. The gas may additionally or alternatively be passed through a diffuser, upstream or downstream of the oscillation.

The gas is commonly air.

The method generally includes a step of preheating the sheet by exposure to a flow of heated gas, to soften the sheet prior to bringing the sheet and article into contact.

Commonly, the flow of heated gas will also be caused to be diverted in oscillating manner during the sheet preheating step.

The method may include an optional step of preheating the articles, again typically by exposure to a flow of heated gas diverted in oscillating manner.

The preheated sheet and article are conveniently caused to come into contact by exposure to a vacuum. The vacuum is suitably at a level in the range 30 to 85 kPa (e.g. about 50 kPa) below atmospheric.

The method typically includes a final cooling step.

Preheating of the articles is typically at a temperature in the range 100 to 120° C. for about 30 seconds, with conditions depending on the material of the surface of the article to be printed.

Preheating of the sheet is typically at a temperature in the range 80 to 170° C. for about 30 seconds, with a temperature of about 145° C. for 15 seconds or 20 seconds or about 130° C. for 30 seconds being suitable for Pictaflex media.

Dye transfer is typically effected by heating at a temperature in the range 120 to 240° C., commonly about 160° C., for a time in the range 15 seconds to 5 minutes, with conditions depending on factors including the dyes, sheet and article.

The invention also includes within its scope an article bearing a printed image produced by the apparatus or method of the invention.

An embodiment of a vacuum press in accordance with the invention for thermal transfer printing of an image from a thermal retransfer intermediate sheet on to a 3D article will now be described, by way of illustration, with reference to the accompanying drawings, in which.

Figure 5A:
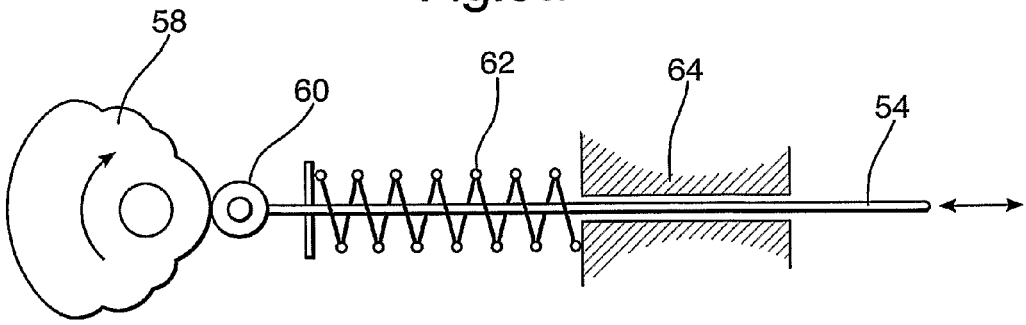
Figure 5B:
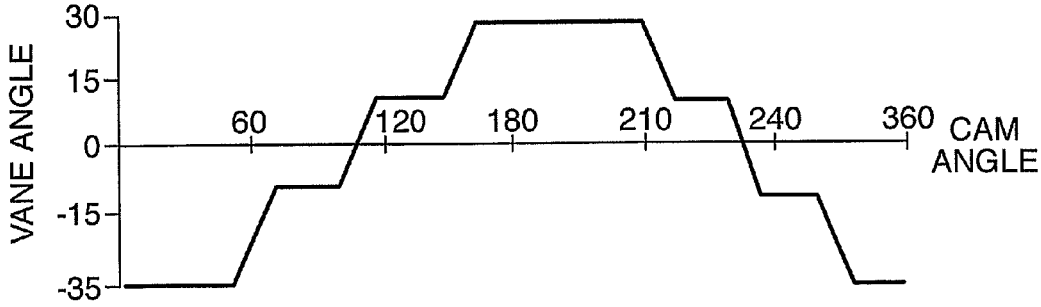

FIG. 5*a* is a schematic view of a cam of the press; and FIG. 5*b* is a graph of vane angle versus cam angle for the cam shown in FIG. 5*a*.

DETAILED DESCRIPTION OF THE DRAWINGS

Figure 1:
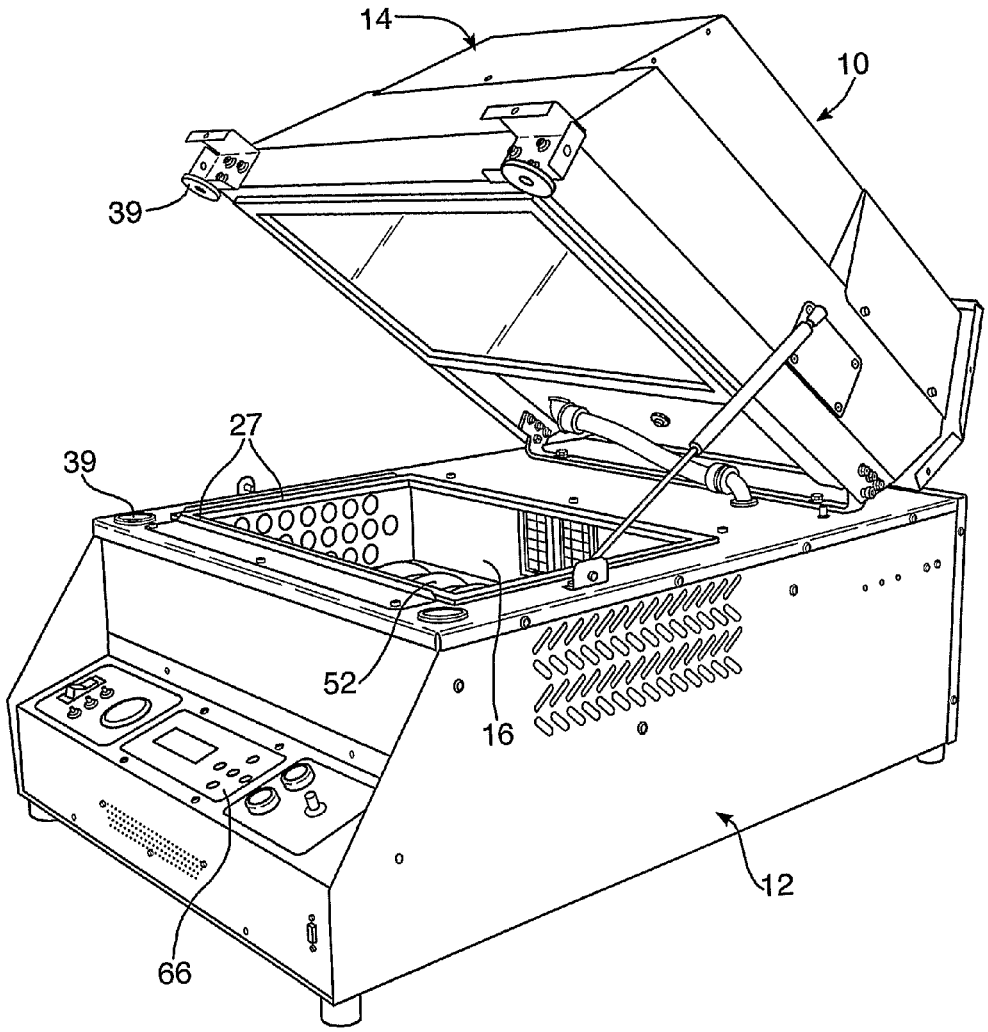
FIGS. 1 and 2 are perspective drawings of the vacuum press.
Figure 2:
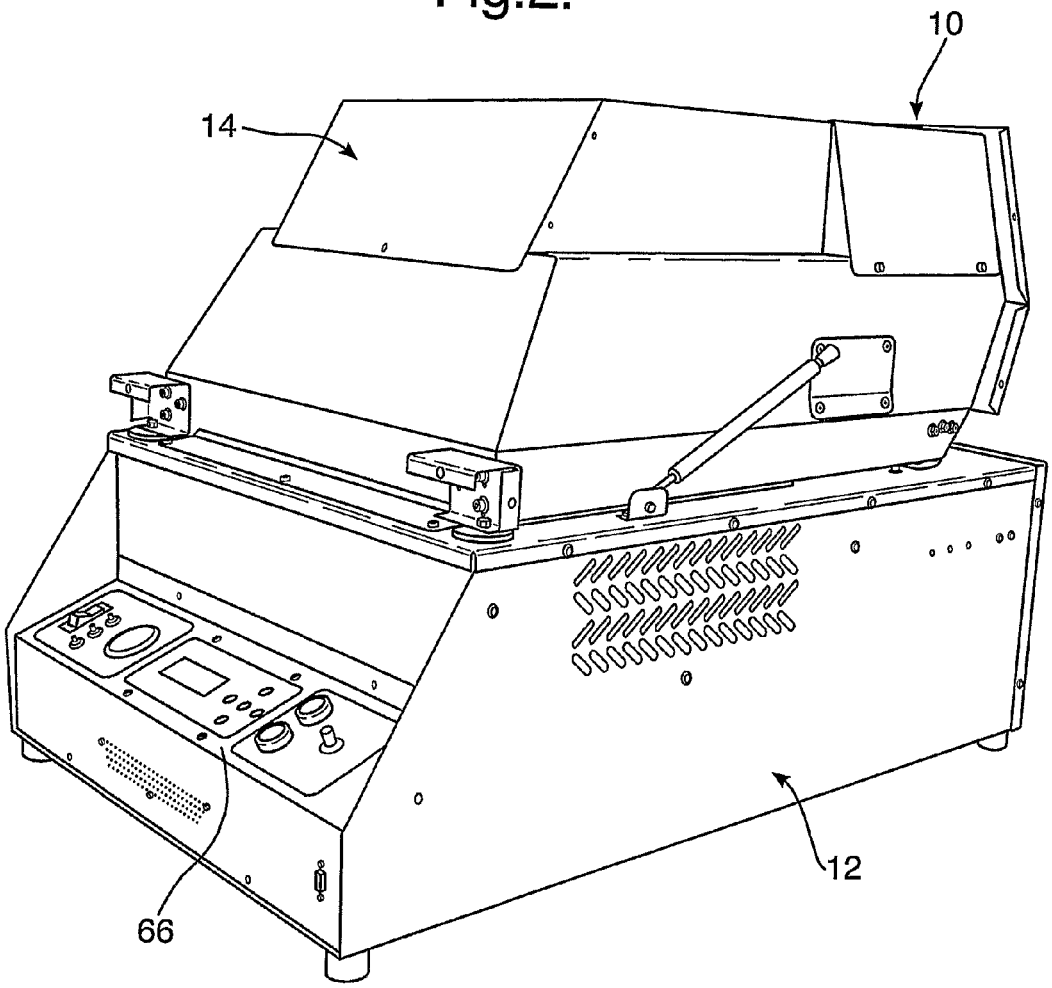

The illustrated vacuum press 10 is in the form of an A3 format desktop unit designed for use with an A3 retransfer sheet. The press is of generally cuboid shape, with overall dimensions of 800 mm depth, 600 mm height and 600 mm width. The press comprises a housing having a base unit 12 and a lid unit 14 hingedly connected thereto at the rear, with the lid unit being movable manually between an initial open position (as shown in FIG. 1) and a closed position for use (as shown in FIG. 2).

Figure 3:
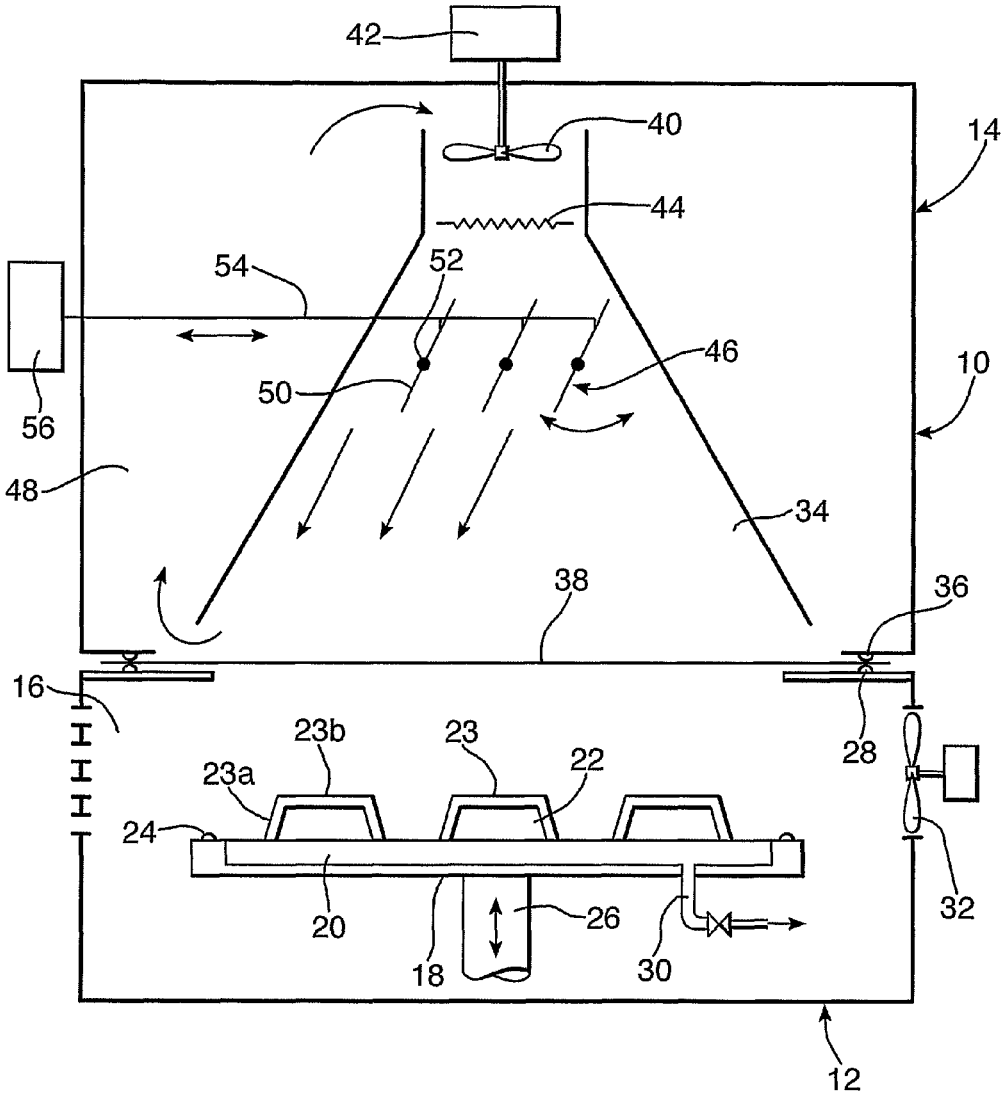
FIGS. 3 and 4 are schematic sectional views of internal components of the press at different stages in operation.
Figure 4:
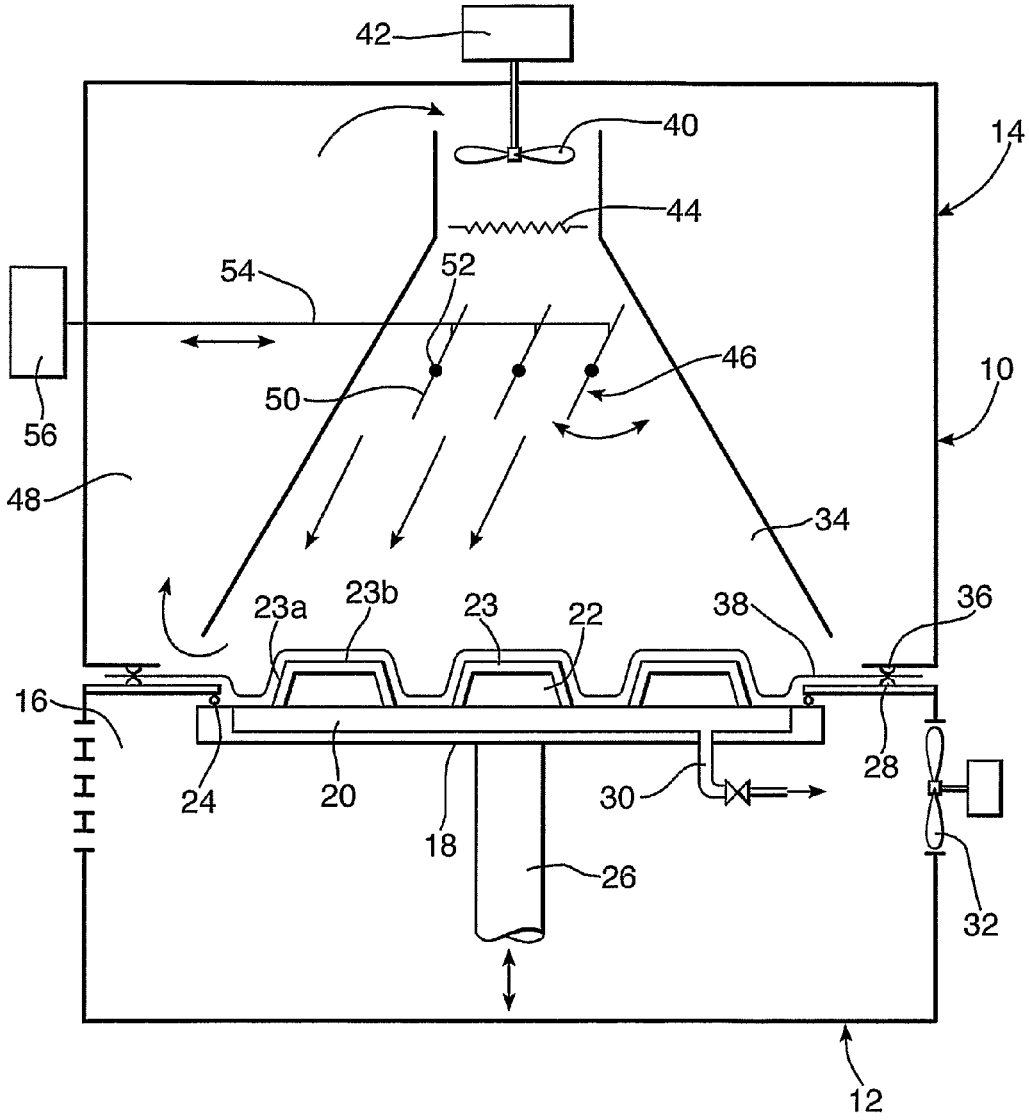

The base unit includes a recess 16 in which, is located a table 18 for receiving an array of 3D articles to be printed on or decorated. Resting on table 18 is a nest plate 20 of porous aluminium or fibre carrying an array of nests or moulds 22 shaped to be complementary to the items 23 to be printed on, to act as a support therefor and prevent distortion of items such as thin-walled plastics articles that might otherwise occur on heating. A peripheral rubber seal 24 is provided on the upper surface of the nest plate 20 to seal within the base unit. Table 18 can be raised and lowered on a shaft 26 by a lifting cylinder mechanism (not shown) from an initial lowered position (as shown in FIGS. 1 and 3) to a raised position (as shown in FIG. 4).

The periphery of the recess 16 is surrounded by linear film guides 27 (visible in FIG. 1) for accurately locating an A3 retransfer sheet in position over the recess and retaining the sheet in position, resting on a peripheral rubber seal 28.

The base unit 12 includes a vacuum system including a vacuum pump and bleed valve (not shown) for generating a vacuum in a flexible hose 30 that passes through table 18 to draw air out from immediately beneath the nest plate 20.

The base unit also includes a cooling fan 32 with associated electric motor.

The lid unit 14 includes a recess 34 the periphery of which is surrounded by a rubber seal 36 that cooperates with the seal 28 of the base unit to secure and seal a retransfer sheet 38 therebetween in the housing when the lid unit is in the closed position. Magnetic locks 39 (visible in FIG. 1) are provided for securing the lid unit in the closed position.

The lid unit 14 includes heating means comprising a fan 40 with associated motor 42 and downstream electrical heater elements 44 for directing a flow of hot air downwardly in the lid unit. Oscillating vane means 46 are located in the lid unit, downstream of heater elements 44, for diverting heated air in an oscillating manner to cause more even heating of the articles. Heated air passes upwardly through channels 48 to be recirculated within the housing.

The oscillating vane means 46 comprise a triple vane assembly having three similar elongated planar vanes 50 each pivotally mounted in the centre at 52 and ganged together by means of a push rod 54 to move in unison in response to reciprocating movement of the push rod 54. The push rod 54 is driven at a rate of 25 strokes per minute by an electric vane motor represented at 56 under control of a cam 58 (FIG. 5*a*) to convert the rotary motion of the motor into appropriate linear motion of the push rod 54, with the push rod terminating in a cam follower 60 and extending through a biasing spring 62 and linear bearing 64.

The cam 58 is as shown in FIG. 5 and is shaped to produce an oscillation profile of the oscillating vane means 46 designed to produce a flow of heated air giving even heating to all surfaces of the articles 23 to be printed on. In particular, it is important that the vertical sides 23*a* reach the same temperature as the horizontal surfaces 23*b* for uniform dye transfer. It is also important that the outermost articles are heated to the same extent as the centrally located article. To this end, the cam 58 is designed to produce an oscillation profile with heated air being directed for a relatively longer time in the troughs between the articles and at the extremities of the vane movements compared with the length of time when heated air is directed at the upper surfaces 23*b* and in the centre of the vane movement. FIG. 5*b* is a graph relating vane position to cam position. The vanes are oscillated symmetrically with a range of movement of about 60°.

In use of the apparatus, the vanes 50 are oscillated by the push rod whenever the heater fan 40 is running.

The apparatus includes computer control means (not shown) and a control panel 66 including display means at the front of the base unit, visible in FIGS. 1 and 2.

In use, an image to be printed on a 3D article is printed (in reverse) onto a suitable retransfer intermediate sheet 38. In one embodiment an image is printed onto Pictaflex A3+ roll media from ICI Imagedata (Pictaflex is a Trade Mark) by an inkjet printing process on an Epson 4400 printer (Epson is a Trade Mark) using Artainium dye sublimation inks (Artainium is a Trade Mark), cut to A3 sheet size and allowed to dry.

Items to be printed on, represented by articles 23, are placed in the base unit 12, each resting on a respective nest 22, with the surface to be decorated uppermost. Depending on the nature of the surface of the article on which the image is to be formed, it may be appropriate to pretreat the surface by application of a surface coating or lacquer to improve the take up of transferred dyes.

The lid unit 14 is moved manually to the closed position.

The heating means is activated in an article preheating step, with the fan 40 causing hot air at a temperature of about 110° C. to be recirculated within the housing for about 30 seconds with the vanes 50 being oscillated at 25 strokes per minute. This acts to preheat the articles to be decorated.

The lid unit 14 is then manually moved to the open position.

The printed A3 Pictaflex film sheet 38 is placed in position on the base unit 12 over recess 16 within the guides and resting on the seal 28, with the printed side facing the article. The lid unit is manually moved to the closed position, being retained by the magnetic lock, sealing sheet 38 in position between seals 28 and seals 36, as shown in FIGS. 3 and 4.

In a film preheating step, the heating means is activated, with the fan and oscillating vanes causing hot air at a temperature of about 145° C. to be recirculated within the apparatus for about 20 seconds. At this temperature the film sheet 38 softens and becomes viscoelastic and has a very low yield stress.

While maintaining heating, the table 18 is raised so that articles 23 pass through the softened film 38, as shown in FIG. 4, with the film initially being loosely draped around the article.

In a vacuum step, while maintaining heating the vacuum system in the base unit 12 is then operated, generating a vacuum of 15 inches Hg (about 50 kPa) below atmospheric beneath the film, via hose 30, which acts to draw the film against the articles, as shown in FIG. 4, with the seals 24 and 28 acting to maintain a vacuum. The softened film conforms to the shape of the articles 23. The temperature of the heating means is raised in a dye transfer step to generate hot air at a temperature of about 160° C., with the temperature being held at this level for about 120 seconds. At this elevated temperature dye diffuses from the film into the adjacent surface of the article. The oscillation of the vanes 50 during the dye transfer step acts to produce a uniform temperature profile across the surfaces being printed, resulting in uniform printing.

The table 18 is lowered after an appropriate time, and the vacuum released. In a cooling step, cold air is blown upwardly in the base unit 12 by the cooling fan 32 for about 20 seconds to impinge on the articles 23 from below. This acts to cool the articles and sheet.

The lid unit 14 is then manually moved to the open position. The film sheet 38 is removed and discarded and the articles 23 removed.

Operation of the heating means, vacuum system and cooling fan are under the control of the computer control means. The apparatus includes a number of preset programs suitable for a printing a variety, of different materials, and is also programmable by a user to suit other requirements.

Comparative tests have been carried out using apparatus in accordance with the invention, including the oscillating vane means, and comparable apparatus with an arrangement of fixed vanes to distribute the hot gas flow. These have shown that more uniform prints of superior quality were obtained using apparatus in accordance with the invention.

EXAMPLE 1

A test image was created with a uniform mid-grey background. A sheet of Pictaflex film was printed with this test image using Artainium UV+ inks in an Epson 4400 inkjet printer (Epson is a Trade Mark). This image was transferred to two different substrates in a press as described above. The oscillation of the vane was sinusoidal with a period of 5 seconds.

Substrate A) was a polyester-coated 0.5 mm thick sheet of aluminium supported on table 18.

Substrate B) was a moulded polycarbonate shell 1.8 mm thick, coated with a retransfer lacquer in the manner described in U.S. Pat. No. 7,102,660. The shell was supported on a silicone rubber nest 22, preheated by running one retransfer cycle without a part.

The press conditions were as follows:

| | Test number | | | |
|---|---|---|---|---|
| | 1 | 2 | 3 | 4 |
| Substrate | A | B | A | B |
| Preheat | none | 60 s at 150° C. | none | 60 s at 150° C. |
| Film softening | 15 s at 145° C. | 20 s at 145° C. | 15 s at 145° C. | 20 s at 145° C. |
| Image transfer | 80 s at 160° C. | 240 s at 140° C. | 80 s at 160° C. | 240 s at 140° C. |
| Air distribution | static diffuser | static diffuser | moving vane | moving vane |

The optical density of the transferred images was measured on a grid covering the width and the height of the parts.

| | Test number | | | |
|---|---|---|---|---|
| | 1 | 2 | 3 | 4 |
| minimum | 0.42 | 0.34 | 0.43 | 0.32 |
| 10th percentile | 0.47 | 0.39 | 0.47 | 0.37 |
| 90th percentile | 0.67 | 0.56 | 0.59 | 0.46 |
| maximum | 0.69 | 0.66 | 0.6 | 0.53 |
| 80% range | 0.2 | 0.17 | 0.12 | 0.09 |
| full range | 0.27 | 0.32 | 0.17 | 0.21 |
| std deviation | 0.076 | 0.070 | 0.044 | 0.038 |

This shows that the moving vane gives superior uniformity of transferred image compared with a static diffuser.

EXAMPLE 2

A test image was created with solid narrow vertical and horizontal black lines arranged in a uniform half-inch grid pattern. A sheet of Pictaflex film was printed with this test image using Artainium UV+ inks in a Mimaki JV5-130S inkjet printer (Mimaki is a Trade Mark). This image was transferred to a polyester-coated 0.5 mm thick sheet of aluminium in a press as described above. The press conditions were as follows:

| | Test number | | | |
|---|---|---|---|---|
| | 1 | 2 | 3 | 4 |
| Preheat | none | none | none | none |
| Film softening | 15 s at 145° C. | 20 s at 130° C. | 15 s at 145° C. | 20 s at 130° C. |
| Image transfer | 80 s at 160° C. | 80 s at 160° C. | 80 s at 160° C. | 80 s at 160° C. |
| Air distribution | static diffuser | static diffuser | moving vane | moving vane |

The percentage increase in width and height of the transferred image was measured.

| | Test number | | | |
|---|---|---|---|---|
| | 1 | 2 | 3 | 4 |
| width | 0.7 | 0.2 | 0.2 | 0.0 |
| height | 2.8 | 1.4 | 1.6 | 0.2 |

This shows that the moving vane gives lower distortion during the film softening phase compared with a static diffuser.

The invention claimed is:

1. An apparatus for thermal transfer printing of an image from a thermal retransfer sheet onto an article, wherein the apparatus includes heating means adapted to supply a flow of heated gas for causing dye transfer, and oscillating vane means for directing the heated gas in a direction transverse to the direction of flow, for distributing the heated gas over article(s) during dye transfer.

2. The apparatus according to claim 1, wherein the oscillating vane means comprises one or more elongate vanes mounted for oscillating movement.

3. The apparatus according to claim 2, wherein the or each vane is secured to a reciprocating member.

4. The apparatus according to claim 3, wherein the reciprocating member is driven by a cam.

5. The apparatus according to claim 1, further comprising a diffuser assembly arranged to direct heated gas in a direction transverse to the distribution produced by the oscillating vane means.

6. The apparatus according to claim 1, further comprising a second oscillating vane means for directing heated gas in a direction transverse to the distribution produced by the first oscillating vane means.

7. The apparatus according to claim 1, wherein the heating means comprises a heater element and fan.

8. The apparatus according to claim 1, further including means for causing relative movement between the article and sheet, to bring the sheet and article into contact.

9. A method of printing an image from a thermal retransfer sheet onto an article, comprising causing the sheet and article to come into contact; and heating the sheet by exposure to a flow of heated gas to cause dye transfer from the sheet to the article, wherein the heated gas is directed in an oscillating manner in a direction transverse to the direction of flow, to distribute the heated gas over the article during dye transfer.

10. The method according to claim 9, wherein the gas is directed by oscillating vane means.

11. The method according to claim 10, wherein the oscillating vane means are controlled by a cam.

12. The method according to claim 9, wherein the oscillation rate is in the range 5 to 200 strokes per minute.

13. The method according to claim 9, wherein the heated gas is directed in oscillating manner in a second direction transverse to the first direction.

14. The method according to claim 9, further comprising preheating the sheet.

* * * * *